US007905099B2

(12) United States Patent
Justak

(10) Patent No.: US 7,905,099 B2
(45) Date of Patent: Mar. 15, 2011

(54) PREDICTIVE MAINTENANCE METHOD AND APPARATUS FOR HVACR SYSTEMS

(76) Inventor: John F. Justak, Stuart, FL (US)

( * ) Notice: Subject to any disclaimer, the term of this patent is extended or adjusted under 35 U.S.C. 154(b) by 401 days.

(21) Appl. No.: 12/124,231

(22) Filed: May 21, 2008

(65) Prior Publication Data

US 2009/0288433 A1 Nov. 26, 2009

(51) Int. Cl.
*F25B 49/00* (2006.01)
*G01N 29/02* (2006.01)

(52) U.S. Cl. ..... 62/127; 62/129; 73/19.03; 73/19.1; 250/574

(58) Field of Classification Search ..... 62/125, 62/126, 127, 129; 73/19.01, 19.03, 19.1; 250/573, 574
See application file for complete search history.

(56) References Cited

U.S. PATENT DOCUMENTS

| | | | | |
|---|---|---|---|---|
| 3,412,570 A | | 11/1968 | Pruett, Sr. | |
| 4,064,826 A | * | 12/1977 | Pauli | 116/276 |
| 4,235,095 A | * | 11/1980 | Liebermann | 73/19.03 |
| 4,644,755 A | | 2/1987 | Esslinger et al. | |
| 5,036,697 A | * | 8/1991 | Fujiwara et al. | 73/19.1 |
| 5,072,595 A | | 12/1991 | Barbier | |
| 5,341,649 A | | 8/1994 | Nevitt et al. | |
| 5,596,507 A | | 1/1997 | Jones et al. | |
| 6,118,134 A | | 9/2000 | Justak | |
| 6,664,558 B1 | * | 12/2003 | Barbier | 250/577 |

FOREIGN PATENT DOCUMENTS

| | | | |
|---|---|---|---|
| EP | 0 488 775 | A2 | 6/1992 |
| EP | 0 491 552 | A2 | 6/1992 |
| EP | 1 400 788 | A1 | 3/2004 |
| JP | 07151433 | A | 6/1995 |
| JP | 08145518 | A | 6/1996 |
| JP | 2001255046 | A | 9/2001 |
| WO | 97/14943 | A1 | 4/1997 |
| WO | 2007/089200 | A1 | 8/2007 |

* cited by examiner

*Primary Examiner* — Marc E Norman
(74) *Attorney, Agent, or Firm* — GrayRobinson, P.A.

(57) ABSTRACT

A predictive maintenance method and apparatus for HVACR systems including a sensor capable of detecting the presence of a gaseous phase in the refrigerant fluid at a location wherein solely liquid phase should be present if the system is functioning properly.

25 Claims, 2 Drawing Sheets

PREDICTIVE MAINTENANCE METHOD AND APPARATUS FOR HVACR SYSTEMS

FIELD OF THE INVENTION

This invention relates to heating, ventilation, air-conditioning and refrigeration (HVACR) systems, and, more particularly, to a method and apparatus capable of detecting malfunctions in the system before they become catastrophic and cannot be remedied by routine maintenance.

BACKGROUND OF THE INVENTION

HVACR systems that operate using a vapor-compression cycle generally comprise a compressor, a condenser, an expansion valve and an evaporator interconnected by a line having an interior within which a refrigerant fluid is circulated. Although this technology is mature and is currently used in a wide variety of commercial and residential applications, malfunctions can arise as a result of leaks in the system or failure of one or more components. In many instances, the malfunction may not be catastrophic, e.g. wherein the system ceases to heat or cool altogether, but may result in a gradual or progressive decrease in performance and/or efficiency that can nevertheless create spoilage of foodstuffs and other inventory, for example, or other problems.

Periodic maintenance of HVACR systems can be time consuming, expensive and in many cases unnecessary at the time performed. Recognizing that a failure to maintain such systems will eventually cause a problem, the issue becomes how often such maintenance should be performed and what should be done. Approaches that rely solely on the passage of time are often ineffective and ignore the specific requirements of a particular installation and/or type of system.

Automated preventative maintenance devices for HVACR systems have been proposed, such as disclosed, for example, in U.S. Pat. No. 5,596,507. The device disclosed in the '507 patent relies upon a number of temperature sensors and electrical current sensors to detect a variety of operating parameters of the system, and to provide inputs to a computer capable of analyzing the data and identifying potential trouble spots in the system that may need maintenance. While systems of this type may be effective, they are not economically feasible for residential applications and many smaller commercial operations.

SUMMARY OF THE INVENTION

This invention is directed to a predictive maintenance method and apparatus for HVACR systems including a sensor capable of detecting the presence of a gaseous phase in the refrigerant fluid at a location wherein solely liquid phase should be present if the system is functioning properly.

In the presently preferred embodiment, the method and apparatus of this invention is particularly intended for use in a vapor-compression system including a compressor, a condenser, an expansion valve and an evaporator interconnected by a line having an interior within which a refrigerant fluid is circulated. The apparatus comprises a sensor positioned in the line at a location between the condenser and expansion valve wherein the refrigerant fluid, if the system is functioning properly, is in liquid phase. The sensor is effective to detect the presence of gas bubbles in the refrigerant fluid, and provide a warning indication that maintenance of the system is required.

Unlike prior predictive maintenance systems, the method and apparatus of this invention is relatively simple, inexpensive and may be easily installed in residential and commercial HVACR systems. While no specific indication of the cause of a problem in the system is provided, it is contemplated that competent service personnel can readily identify and repair the HVACR system when notified of a maintenance issue, thus substantially eliminating the need for periodic inspections of such system.

BRIEF DESCRIPTION OF THE DRAWINGS

The structure, operation and advantages of the presently preferred embodiment of this invention will become further apparent upon consideration of the following description, taken in conjunction with the accompanying drawings, wherein.

DETAILED DESCRIPTION OF THE INVENTION

Figure 1:
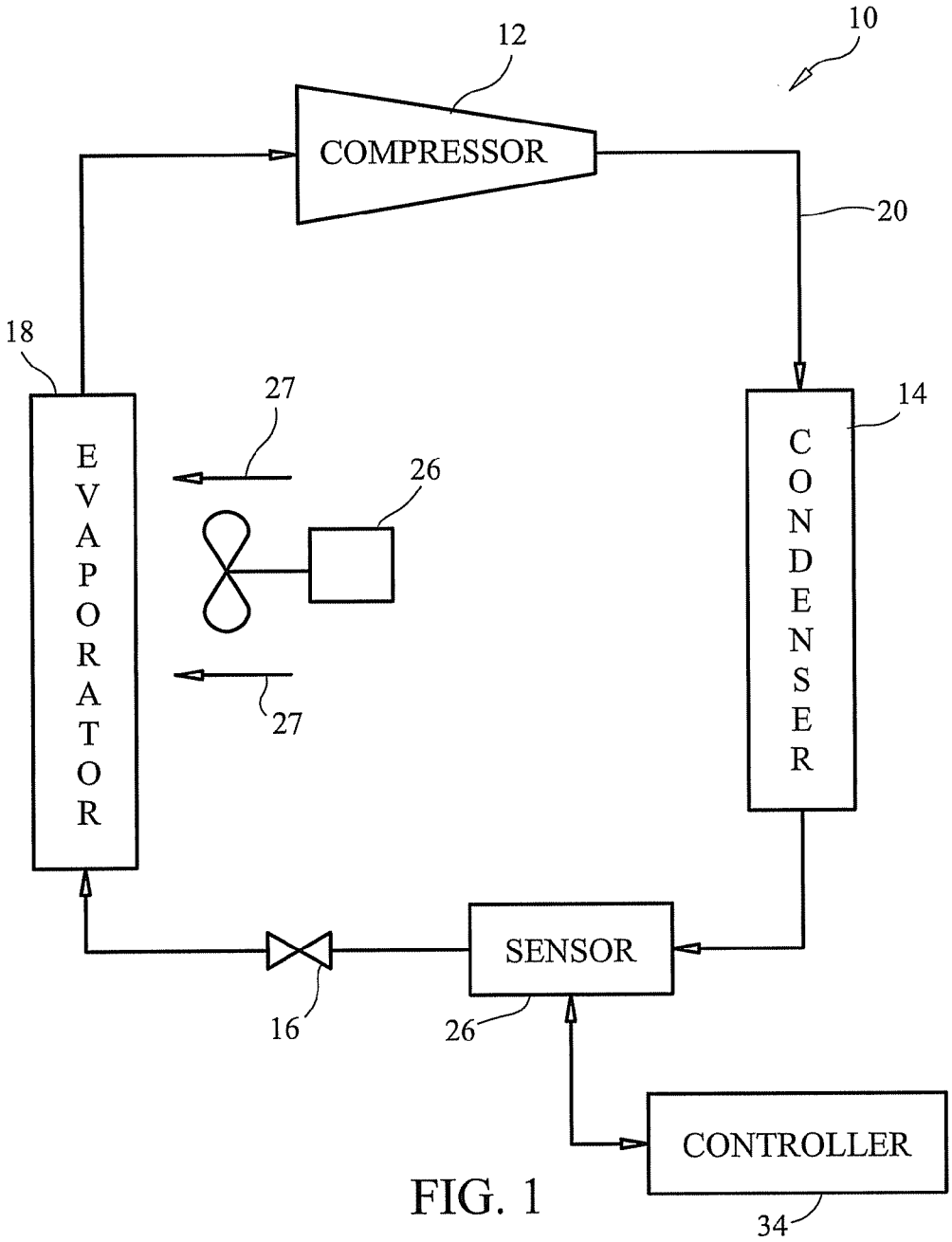
FIG. 1 is a schematic view of a vapor-compression system incorporating the predictive maintenance system of this invention.

Referring now to the drawings, an HVACR system 10 is schematically depicted that operates by vapor compression in a conventional manner. The details of system 10 form no part of this invention and are therefore discussed generally herein. The system 10 includes a compressor 12, a condenser 14, an expansion valve 16 and an evaporator 18 interconnected by a line 20 having an interior 22 within which a refrigerant fluid 24 is circulated in the direction of the arrows shown in FIG. 1. The fluid 24 may be a hydrofluorocarbon or a similar environmentally suitable refrigerant.

The fluid 24 undergoes phase changes and temperature changes in the course of passage through the system 10 that may be used for heating or cooling purposes depending upon the particular application for which the system 10 is employed. Assuming for purposes of discussion that the system 10 is utilized in a refrigeration or air conditioning application, fluid 24 in saturated vapor form is initially directed to the intake of the compressor 12. The compressor 12 is effective to compress the saturated vapor which increases its pressure and temperature, forming a superheated vapor. The superheated vapor is discharged from the compressor 12 and enters the condenser 14. The condenser 14 is formed with a number of coils (not shown) through which the superheated vapor is directed. The coils are cooled by circulating air or water in order to remove heat from the superheated vapor and convert it into a saturated liquid that is transmitted to the expansion valve 16. If the system 10 is functioning properly, the fluid 24 is in a saturated liquid phase throughout the passage within line 20 from the condenser 14 to the expansion valve 16.

The purpose of the expansion valve 16 is to create an abrupt lowering of the pressure of the saturated liquid received from the condenser 14. This causes adiabatic flash evaporation which lowers the temperature of the refrigerant fluid 24 and produces a mixture of cold refrigerant liquid and vapor. The liquid/vapor mixture discharged from the expansion valve 16 is transmitted to the evaporator 18. In most designs, the evaporator 18 is formed with a number of coils or tubes (not shown) and a fan 26 directs relatively warm air, e.g. from the space that is being cooled, over the coils or tubes. See arrows 27 in FIG. 1. The liquid portion of the liquid/vapor mixture evaporates, and the circulating air is cooled by the mixture thus reducing the temperature of the area to be cooled. The warmer, circulating air passing over the coils or tubes of the evaporator 18 increases the temperature of the fluid 24, and the fluid 24, which is now in saturated vapor form, is transmitted by line 20 to the intake of compressor 12. The cycle described above is then repeated.

As noted above, if the system 10 is operating properly, the refrigerant fluid 24 is in a saturated liquid phase in the course of passage within line 20 between the output of the condenser 14 and the input of the expansion valve 16. The presence of a gaseous phase of the fluid 24 at this location is an indication of a maintenance issue, e.g. that there is a leak in the system 10 or one or more of the components 12-18 is not functioning normally. In accordance with a presently preferred embodiment of this invention, a predictive maintenance sensor 26 is located in the line 20 between the expansion valve 16 and condenser 14, and preferably immediately upstream from the expansion valve 16. The sensor 26 is effective to detect the presence of a gaseous phase within the fluid 24, and to cause a warning to be produced indicating that maintenance is needed.

Figure 2:
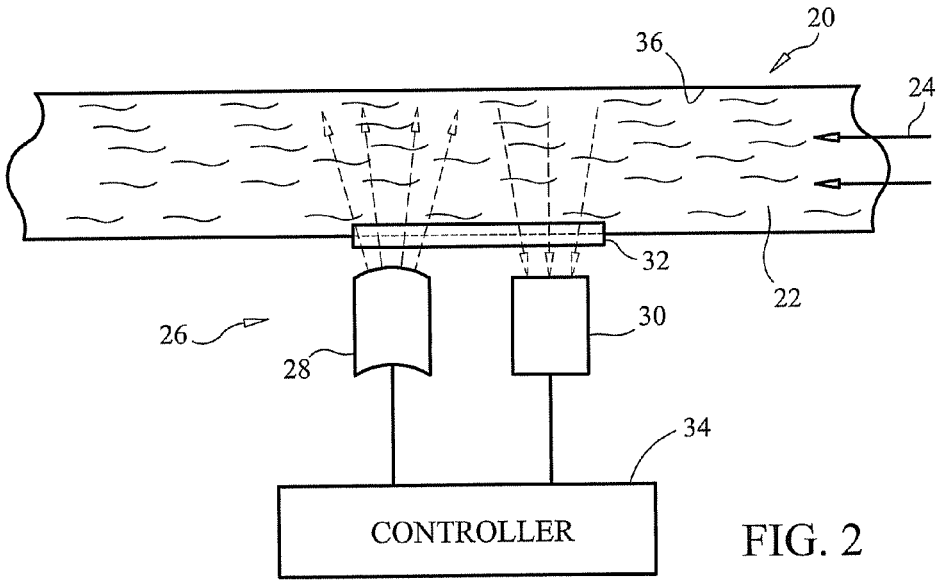
FIG. 2 is an enlarged view of one embodiment of the sensor herein, shown in position relative to the line within which the refrigerant fluid is circulated.

The sensor 26 comprises an emitter 28, a detector 30 and an optical aperture 32 formed in the line 20. A controller 34, discussed in more detail below, is coupled to the emitter 28 and the detector 30. In the embodiment depicted in FIG. 2, the optical aperture 32 is located on one side of the line 20. The optical aperture 32 may be a section of plastic, glass or the like through which radiant energy may be transmitted. The emitter 28 may be a source of radiant energy, such as one or more light emitting diodes (LEDs), that is capable of directing radiant energy through the optical aperture 32 at a wavelength which is not entirely absorbed by the refrigerant fluid 24 circulating within the line 20. As shown in FIG. 2, the emitter 28 is positioned immediately adjacent to the optical aperture 32 to ensure that substantially all of the radiant energy it produces enters the line 20. It is contemplated that a housing (not shown) may be provided to enclose the sensor 26 and protect it from damage.

The detector 30 in the FIG. 2 embodiment of this invention is located on the same side of the line 20 as the emitter 28, preferably side-by-side with the emitter 28 and immediately adjacent to the optical aperture 32. The detector 30 may be a phototransistor or any other suitable means of detecting radiant energy. With the detector 30 located on the same side of the line 20 as the emitter 28, and adjacent thereto, it senses radiant energy that is reflected back from the fluid 24 and/or interior wall 36 of the line 20.

Figure 3:
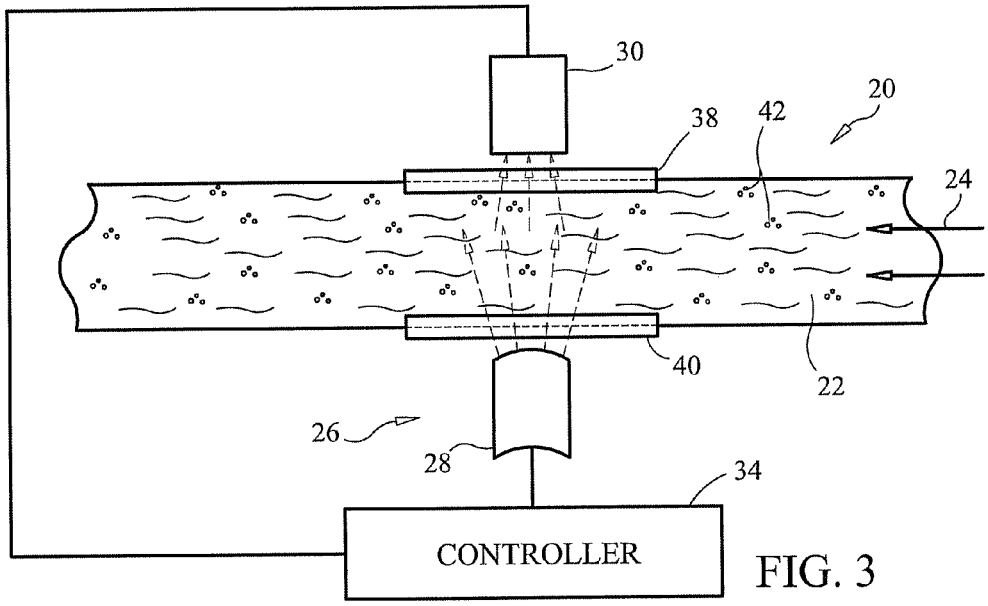
FIG. 3 is a view similar to FIG. 2, except with the sensor components positioned on opposite sides of the line.

An alternative embodiment of this invention is illustrated in FIG. 3 wherein the emitter 28 and detector 30 of the sensor 26 are located on opposite sides of the line 20 is substantial alignment with one another. The optical aperture 32 may be formed as a continuous section of radiant energy transmitting material in this embodiment, e.g. extending completely around the line 20, or in two aligning sections 38 and 40 as shown in FIG. 3. Radiant energy produced by the emitter 28 is directed toward the detector 30 which is effective to sense that portion of the radiant energy not absorbed by the fluid 24 within line 20.

For purposes of illustration, the fluid 24 circulating through the line 20 is shown in liquid phase in FIG. 2 and as a mixture of liquid and gaseous phase, e.g. with gas bubbles 42, in FIG. 3. The detector 30 is effective to produce a first signal which is representative of the radiant energy it senses when the fluid 24 is in liquid phase. When the fluid 24 within the line 20 is a combination of liquid and gaseous phase, as depicted in FIG. 3, the detector 30 produces a second signal representative of this condition. Radiant energy is absorbed and transmitted through the fluid 24 in a different manner when it is solely in liquid phase, compared to a mixture of liquid and gaseous phase, and therefore the first and second signals produced by the detector 30 are different from one another.

In the presently preferred embodiment, the optical aperture 32 or the two aligning sections 38, 40 that form an optical aperture are sized to be smaller than at least some of the gas bubbles 42 that are present in the refrigerant fluid 24 when it is a mixture of liquid and gaseous phase. In particular, the optical aperture 32, or sections 38, 40, have a height dimension measured in a direction generally perpendicular to the flow of fluid 24 through the line 20 that is smaller than the diameter of at least some of the gas bubbles 42 present in the fluid 24. For example, an optical aperture 32, or sections 38, 40, having a height dimension of 0.02 inches would readily permit the detection of gas bubbles 42 of that diameter or larger. It is also contemplated that the sections 38 and 40 forming an optical aperture could be oriented 90° from their position shown in FIGS. 2 and 3, thus exhibiting a width dimension measured in a direction generally parallel to the flow of fluid 24 through the line 20. Such width dimension, like the height dimension described above, is also preferably less than the size of gas bubbles 42 that may be present in the fluid 24.

The controller 34 may be any suitable processor capable of operating the emitter 28, receiving the signals produced by the detector 30 and producing a warning indication in the event a second signal is produced. In one presently preferred embodiment, following initial start-up of the system 10, the controller 34 may record a "baseline" value representative of the first signal produced by the detector 30 wherein it is known that the system 10 is operating properly and fluid 24 in the form of a saturated liquid is circulating through the line 20 between the output of the condenser 14 and the input of the expansion valve 16. The controller 34 may operate the emitter 28 and detector 30 periodically or continuously, as desired, to check on the status of the system 10. Subsequent signals produced by the detector 30 are compared to the baseline value, and, if such signals noted above are within a predetermined range of the baseline value, e.g. "first" signals, no warning indication is produced. On the other hand, if a "second" signal is produced representative of the presence of both liquid and gaseous phase within the line 20, a comparison by the controller 34 of such second signal to the baseline value results in the production of a warning indication that maintenance of the system 10 is required. It is contemplated that the warning indication may comprise a flashing light or the like on a refrigeration unit, on the thermostat of an air conditioning system or other suitable indicia.

While the invention has been described with reference to a preferred embodiment, it should be understood by those skilled in the art that various changes may be made and equivalents substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. Apparatus for use in a heating, ventilation, air-conditioning or refrigeration system including a compressor, a condenser, an expansion valve and an evaporator interconnected by a line having an interior within which a refrigerant fluid circulates, said apparatus comprising:

an optical aperture formed in said line at a location between said condenser and said expansion valve;

an emitter operative to direct radiant energy through said optical aperture into said interior of said line at a wavelength that can be transmitted through said refrigerant flowing through said line without being completely absorbed;

a detector operative to produce a first signal upon sensing said radiant energy that is not absorbed by said refrigerant fluid when said refrigerant fluid is in liquid phase, said detector being operative to produce a second signal upon sensing said radiant energy that is not absorbed by said refrigerant fluid when said refrigerant fluid is in both liquid phase and gaseous phase;

a controller coupled to said detector and to said emitter, said controller being effective to provide a warning indication upon receipt of said second signal from said detector.

2. The apparatus of claim 1 in which said line has an interior wall that reflects optical energy, said detector being capable of detecting optical energy from said emitter that is transmitted through said refrigerant flowing through said line and reflected from said interior wall thereof.

3. The apparatus of claim 1 in which said optical aperture formed in said line has a first portion, and a second portion that substantially aligns with said first portion, said emitter being located at said first portion of said optical aperture and said detector being located at said second portion thereof.

4. The apparatus of claim 1 in which said emitter and said detector are located side-by-side at said optical aperture.

5. The apparatus of claim 1 in which gas bubbles are produced when said refrigerant fluid is in both liquid phase and gaseous phase, said optical aperture having a height dimension measured in a direction substantially perpendicular to the flow of refrigerant fluid through the line, said height dimension being less than the size of said gas bubbles in the refrigerant fluid.

6. The apparatus of claim 1 in which gas bubbles are produced when said refrigerant fluid is in both liquid phase and gaseous phase, said optical aperture having a width dimension measured in a direction substantially parallel to the flow of refrigerant fluid through the line, said width dimension being less than the size of said gas bubbles in the refrigerant fluid.

7. The apparatus of claim 1 in which said emitter is a light emitting diode.

8. The apparatus of claim 1 in which said detector is a phototransistor.

9. A refrigerant system, comprising:

a compressor, a condenser, an expansion valve and an evaporator interconnected by a line having an interior within which a refrigerant fluid is circulated, said refrigerant fluid being substantially in liquid phase when flowing between said condenser and said expansion valve;

a sensor connected to said line between said condenser and said expansion valve, said sensor including:

(i) an optical aperture;

(ii) an emitter operative to direct radiant energy through said optical aperture into said interior of said line at a wavelength that can be transmitted through said refrigerant flowing through said line without being completely absorbed;

(iii) a detector operative to produce a first signal upon sensing said radiant energy that is not absorbed by said refrigerant fluid when said refrigerant fluid is in liquid phase, said detector being operative to produce a second signal upon sensing said radiant energy that is not absorbed by said refrigerant fluid when said refrigerant fluid is in both liquid and gaseous phase;

a controller coupled to said detector device and to said emitter device, said controller being effective to provide a warning indication upon receipt of said second signal from said detector.

10. The refrigerator system of claim 9 in which said line has an interior wall that reflects optical energy, said detector being capable of detecting optical energy from said emitter that is transmitted through said refrigerant flowing through said line and reflected from said interior wall thereof.

11. The refrigerator system of claim 9 in which said optical aperture formed in said line has a first portion, and a second portion that substantially aligns with said first portion, said emitter being located at said first portion of said optical aperture and said detector being located at said second portion thereof.

12. The refrigerator system of claim 9 in which said emitter and said detector are located side-by-side at said optical aperture.

13. The refrigerator system of claim 9 in which gas bubbles are produced when said refrigerant fluid is in both liquid phase and gaseous phase, said optical aperture having a height dimension measured in a direction substantially perpendicular to the flow of refrigerant fluid through the line, said height dimension being less than the size of said gas bubbles in the refrigerant fluid.

14. The refrigerator system of claim 9 in which gas bubbles are produced when said refrigerant fluid is in both liquid phase and gaseous phase, said optical aperture having a width dimension measured in a direction substantially parallel to the flow of refrigerant fluid through the line, said width dimension being less than the size of said gas bubbles in the refrigerant fluid.

15. The refrigerator system of claim 9 in which said emitter is a light emitting diode.

16. The refrigerator system of claim 9 in which said detector is a phototransistor.

17. A method of detecting a malfunction in a heating, ventilation, air-conditioning or refrigeration system including a compressor, a condenser, an expansion valve and an evaporator interconnected by a line having an interior within which a refrigerant fluid is circulated, comprising:

(a) positioning a sensor having an optical aperture, an emitter and a detector in the line at a location between the condenser and the expansion valve;

(b) operating the emitter to introduce radiant energy through the optical aperture and into the interior of the line at a wavelength that is not completely absorbed by the refrigerant fluid;

(c) operating the detector to detect the radiant energy not absorbed by the refrigerant fluid and to produce a first signal in the event the refrigerant fluid is substantially in liquid phase;

(d) operating the detector to detect the radiant energy not absorbed by the refrigerant fluid and to produce a second signal in the event the refrigerant fluid is a mixture of liquid phase and gaseous phase;

(e) generating a warning indication upon the production of a second signal.

18. The method of claim 17 in which step (a) includes locating the emitter at a first portion of the optical aperture and locating the detector at a second portion of the optical aperture which substantially aligns with the first portion thereof.

19. The method of claim 17 in which step (a) includes locating the emitter and the detector adjacent to one another at the optical aperture, the detector being capable of sensing radiant energy emitted from the emitter and reflected from the interior wall of the line.

20. The method of claim 17 in which step (e) includes comparing a second signal produced by the detector to a first signal and generating the warning indication if the first and second signals are different from one another.

21. Apparatus for use in a heating, ventilation, air-conditioning or refrigeration system including a compressor, a condenser, an expansion valve and an evaporator interconnected by a line having an interior within which a refrigerant fluid circulates, said apparatus comprising:

an optical aperture formed in said line at a location between said condenser and said expansion valve, the refrigerant fluid being in liquid phase or a combination of liquid phase and gas bubbles at the location of said optical aperture in said line, said optical aperture having a height dimension measured in a direction substantially perpendicular to the flow of refrigerant fluid through said line which is less than the size of at least some of said gas bubbles in the refrigerant fluid;

an emitter operative to direct radiant energy through said optical aperture into said interior of said line at a wavelength that can be transmitted through said refrigerant flowing through said line without being completely absorbed;

a detector operative to produce a first signal upon sensing said radiant energy that is not absorbed by said refrigerant fluid when said refrigerant fluid is in liquid phase, said detector being operative to produce a second signal upon sensing said radiant energy that is not absorbed by said refrigerant fluid when said refrigerant fluid is in a combination of liquid phase and gas bubbles;

a controller coupled to said detector and to said emitter, said controller being effective to provide a warning indication upon receipt of said second signal from said detector.

22. The apparatus of claim 21 in which said optical aperture has a width dimension measured in a direction substantially parallel to the flow of refrigerant fluid through the line, said width dimension being less than the size of at least some of said gas bubbles in the refrigerant fluid.

23. A refrigerant system, comprising:

a compressor, a condenser, an expansion valve and an evaporator interconnected by a line having an interior within which a refrigerant fluid is circulated;

a sensor connected to said line between said condenser and said expansion valve, the refrigerant fluid being in liquid phase or a combination of liquid phase and gas bubbles at the location of said sensor in said line, said sensor including:

(i) an optical aperture having a height dimension measured in a direction substantially perpendicular to the flow of refrigerant fluid through said line which is less than the size of at least some of said gas bubbles in the refrigerant fluid;

(ii) an emitter operative to direct radiant energy through said optical aperture into said interior of said line at a wavelength that can be transmitted through said refrigerant flowing through said line without being completely absorbed;

(iii) a detector operative to produce a first signal upon sensing said radiant energy that is not absorbed by said refrigerant fluid when said refrigerant fluid is in liquid phase, said detector being operative to produce a second signal upon sensing said radiant energy that is not absorbed by said refrigerant fluid when said refrigerant fluid is in both liquid and gaseous phase;

a controller coupled to said detector device and to said emitter device, said controller being effective to provide a warning indication upon receipt of said second signal from said detector.

24. The apparatus of claim 23 in which said optical aperture has a width dimension measured in a direction substantially parallel to the flow of refrigerant fluid through the line, said width dimension being less than the size of at least some of said gas bubbles in the refrigerant fluid.

25. A method of detecting a malfunction in a heating, ventilation, air-conditioning or refrigeration system including a compressor, a condenser, an expansion valve and an evaporator interconnected by a line having an interior within which a refrigerant fluid is circulated, comprising:

(a) positioning a sensor having an optical aperture, an emitter and a detector in the line at a location between the condenser and the expansion valve, the refrigerant fluid being in liquid phase or a combination of liquid phase and gas bubbles at the location of said sensor in said line, said optical aperture having a height dimension measured in a direction substantially perpendicular to the flow of refrigerant fluid through said line which is less than the size of at least some of said gas bubbles in the refrigerant fluid;

(b) operating the emitter to introduce radiant energy through the optical aperture and into the interior of the line at a wavelength that is not completely absorbed by the refrigerant fluid;

(c) operating the detector to detect the radiant energy not absorbed by the refrigerant fluid and to produce a first signal in the event the refrigerant fluid is substantially in liquid phase;

(d) operating the detector to detect the radiant energy not absorbed by the refrigerant fluid and to produce a second signal in the event the refrigerant fluid is a combination of liquid phase and gas bubbles;

(e) generating a warning indication upon the production of a second signal.

* * * * *